US007021601B2

(12) United States Patent
Vappula

(10) Patent No.: US 7,021,601 B2
(45) Date of Patent: Apr. 4, 2006

(54) DISMOUNTABLE CASTING MOLD SIDE WALL SYSTEM

(75) Inventor: Kari Vappula, Toijala (FI)

(73) Assignee: Consolis Technology Oy AB, Vantaa (FI)

( * ) Notice: Subject to any disclaimer, the term of this patent is extended or adjusted under 35 U.S.C. 154(b) by 110 days.

(21) Appl. No.: 10/383,524

(22) Filed: Mar. 10, 2003

(65) Prior Publication Data

US 2003/0189158 A1 Oct. 9, 2003

(30) Foreign Application Priority Data

Apr. 8, 2002 (FI) ..... 20020153 U

(51) Int. Cl.
*B28B 7/00* (2006.01)

(52) U.S. Cl. ..... 249/139; 249/163; 249/168; 425/DIG. 33

(58) Field of Classification Search ..... 249/139, 249/162, 168, 187.1; 425/3, DIG. 33
See application file for complete search history.

(56) References Cited

U.S. PATENT DOCUMENTS 6,082,701 A * 7/2000 Reymann ..... 249/160
6,202,978 B1 * 3/2001 Vappula ..... 249/187.1
6,276,657 B1 * 8/2001 Vappula ..... 249/163
6,434,894 B1 * 8/2002 Reymann ..... 52/127.7
6,547,209 B1 * 4/2003 Vappula ..... 249/139
6,742,759 B1 * 6/2004 Vappula ..... 249/139
2001/0004819 A1 6/2001 Reymann

FOREIGN PATENT DOCUMENTS

| | | |
|---|---|---|
| EP | 0 512 437 | * 11/1992 |
| EP | 0 639 686 | * 8/1993 |
| EP | 1 106 314 | 3/2000 |
| FI | 4258 | 12/1999 |

OTHER PUBLICATIONS

English abstract for EP 0 512 437.*
English abstract for EP 0 639 686.*

* cited by examiner

*Primary Examiner*—Donald Heckenberg
(74) *Attorney, Agent, or Firm*—Buchanan Ingersoll PC

(57) ABSTRACT

Dismountable casting mold side wall system including a side wall attachable dismountably to the casting mold and a magnet adapted to clamp onto a casting bed so as attach said side wall thereto, in which system the release/clamp operations of the magnet are adapted to take place in the interior space remaining between the exterior sides of said side wall.

11 Claims, 3 Drawing Sheets

DISMOUNTABLE CASTING MOLD SIDE WALL SYSTEM

FIELD OF THE INVENTION

The present invention relates to a side wall system for a concrete casting mold, the system including a side wall panel attachable dismountably by means of at least one magnet adapted to clamp onto a casting bed.

BACKGROUND OF THE INVENTION

Dismountable side walls of concrete product casting molds equipped with different kinds of attachment arrangements are known from the prior art. These side walls structures are attachable in desired positions on the casting bed according to the size and shape of the concrete element being cast.

When modular building panels are to be cast from a concrete mix, casting is generally performed onto a planar-bottom casting mold known as a casting bed, or tipping bed, that is equipped with side walls. The casting machine travels above the bed and meters concrete mix into the mold. After the cast element is cured, the bed is tipped about an axis of rotation aligned at its one edge into an almost vertical position, the side wall thus becoming the top side of the mold is removed and the cast object is elevated away from the casting bed by eyelets provided at its sides. The position of the top wall of the mold must be settable according to the shape of the modular element being cast, whereby this task can be accomplished using dismountable side walls.

By virtue of the dismountable and movable side wall panels, it is also possible to provide a modular building element with door or window openings at desired points.

The use of clamp magnets for attaching dismountable side walls of molds is already known in the art, wherein they are most appropriate for attaching a side wall by adhering to the smooth steel surface of the casting bed. To achieve secure clamping of the side wall, strong magnets must be used to attain a clamping force of, e.g., 15 kN. One example of an embodiment based on the use a clamp magnet is disclosed in FI utility model no. 4258.

Clamp magnets used today for attaching box-section side walls are provided with operating means extending above the top level of the side walls. The mechanical function of the clamp magnets and requirements of robotic handling means thereof necessitate the use of such operating means. One embodiment of this kind is described in patent publication EP 1 106 314.

However, this kind of operating means extending above the top level of the casting mold side walls cause a substantial difficulty in the leveled casting and troweling of the building element top surface inasmuch as the projecting operating means of the clamp magnets obstruct the vibrating and troweling members traveling above the side wall top edges. Moreover, such operating means make it difficult to store the clamp magnets above one another.

BRIEF SUMMARY OF THE INVENTION

In the invention disclosed herein, all user operations needed in the clamping and release of the magnets are carried out in space remaining inside the exterior dimensions of the side wall, thus making it unnecessary to have the operating means projecting outwardly from the mold walls.

The dismountable side wall system according to the invention comprises a box-section side wall adapted to accommodate a ready-assembled clamp magnet unit in the interior of its cross section. For insertion of a tool used in the release and clamping of the side wall, the top edge of the side wall is provided with a narrow opening located as not to have any components therebelow that could be susceptible to damage by concrete mix splashes.

The function of the clamp magnet unit located in the interior space of the side wall is based on a conventional meandering magnet construction, wherein the magnet is connected to a pivoted operating link lever. The clamping of the magnet takes place by pushing the free end of the link lever toward the casting bed and the magnet is released from the casting bed by lifting the free end of the link lever upward. The clamping force of the magnet is adjusted by a limit screw that controls the closest distance of the clamp magnet in its clamping position from the casting bed. In the release step of the side wall, the magnet locks into its upper position by the magnetic force exerted by the back side of the clamp magnet.

The side wall system according to the invention is well suited for robotic handling. An automated handling system may be readily used for locating the side walls, clamping their magnets and, conversely, releasing the magnets and removing the side walls.

BRIEF DESCRIPTION OF THE DRAWINGS

Next, the invention will be examined in greater detail by making reference to the attached drawings, wherein.

DETAILED DESCRIPTION OF THE INVENTION

Figure 1C:
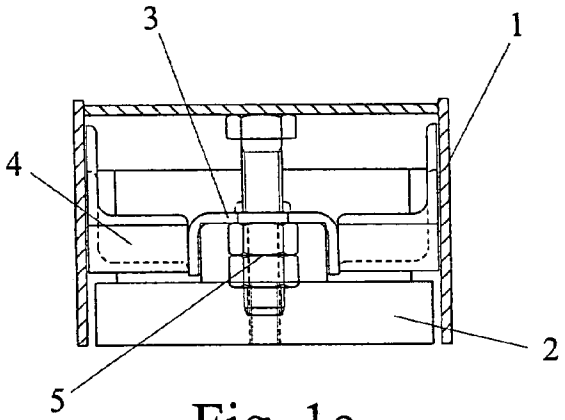
FIGS. 1*a*, 1*b* and 1*c* show a dismountable casting mold side wall system according to the invention.
Figure 1A:
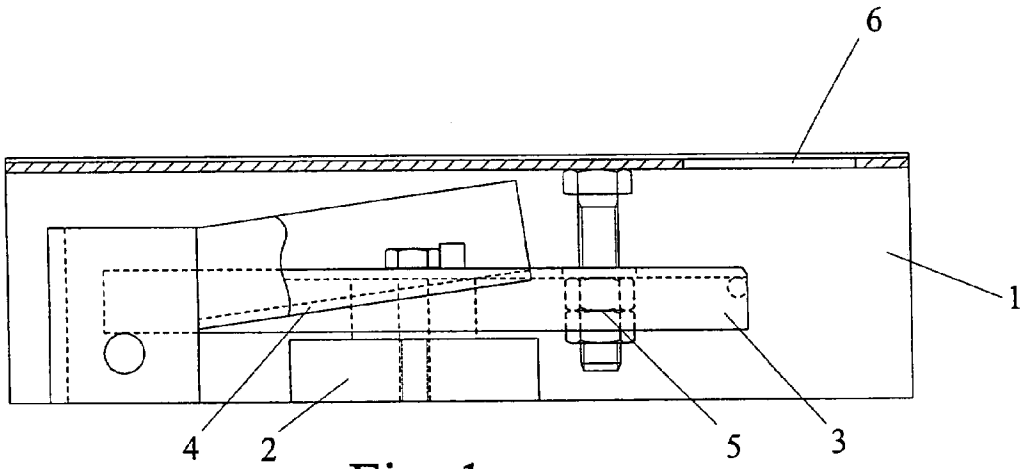
Figure 1B:
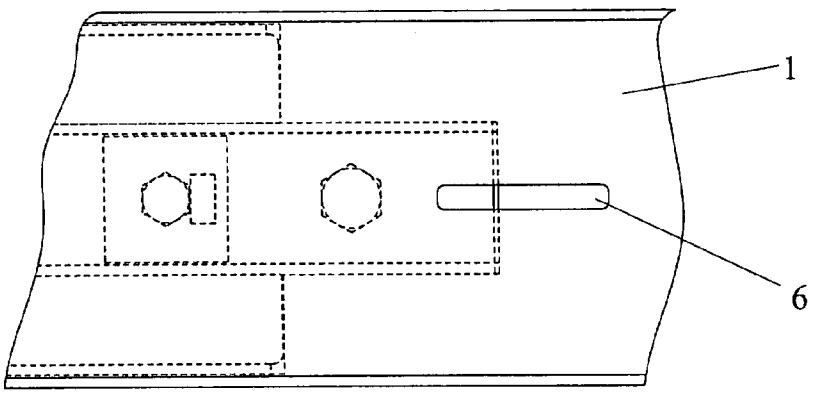

Referring to FIGS. 1*a*, 1*b* and 1*c*, these diagrams show one embodiment of the dismountable casting mold side wall system in different projections. This kind of side wall system comprises a box-section wall 1, a clamp magnet 2, a pivoted operating link lever 3, a surface 4 defining the upper position of the magnet, a limit screw 5 and an opening 6 in the top level edge of the side wall.

In the system, the magnet 2 functions as a clamping component of the side wall system. The clamping of the magnet on the casting bed and release therefrom takes place with the help of an operating link lever 3. In its upper position, the magnet adheres to the surface 4 defining the location of the magnet in its upper position. The limit screw 5 allows magnet clamping force adjustment by way of setting the minimum distance of the magnet from the casting bed. The opening 6 of the side wall top edge allows the introduction of a tool into the interior space of the side wall to clamp or release the side wall system.

Figure 2A:
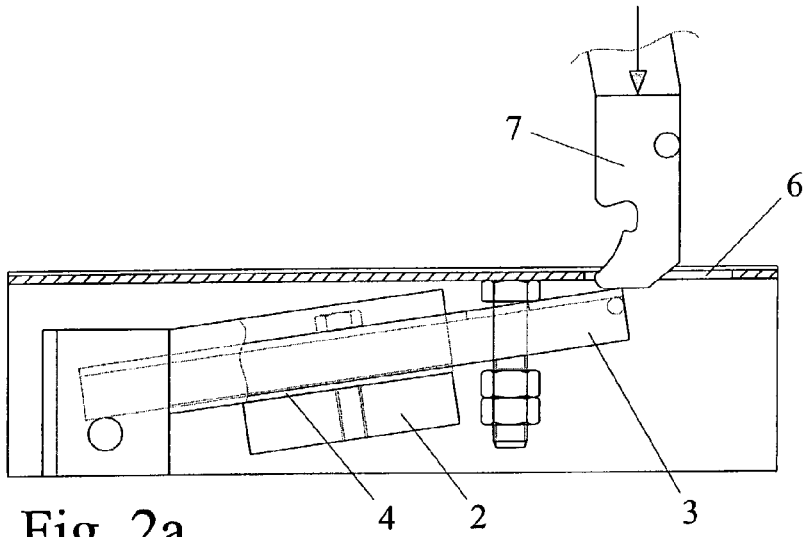
FIGS. 2*a*, 2*b* and 2*c* show the clamping and release steps of the dismountable casting mold side wall system according to the invention.

In FIG. 2*a* are shown the actions needed to be performed by means of a clamp/release tool 7 to clamp the side wall system to the casting bed. When the side wall system is in its dismounted state, the clamp magnet 2 is adhered to the surface 4 defining its upper position. After the side wall system is properly aligned on the casting bed so as to form the casting mold, the clamp/release tool is inserted into the side wall interior via the opening 6 made on the upper edge of the side wall so as to push downward the free end of the magnet operating link lever 3 by means of the tool. Hereby the magnet is released from the surface defining its upper position and the magnet falls against the casting mold thus clamping the side wall system in place.

Figure 2B:
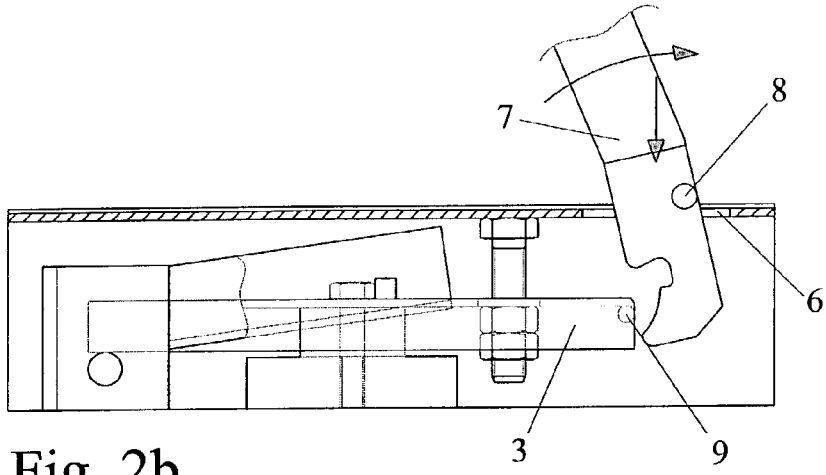
Figure 2C:
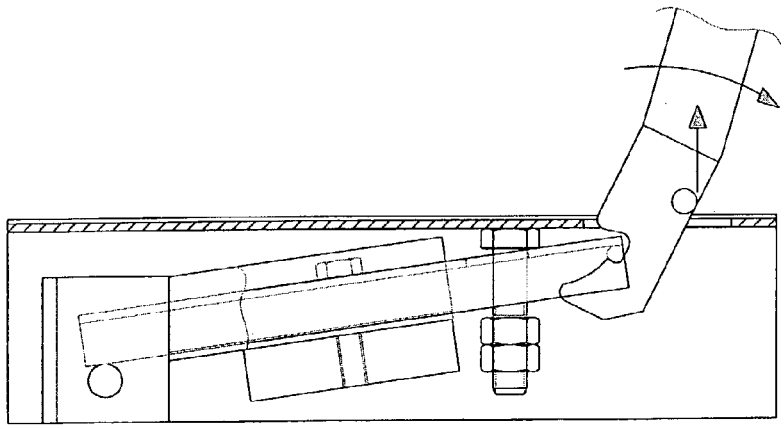

In FIGS. 2*b* and 2*c* are shown the actions needed to be performed by means of the tool 7 to release the side wall system from the casting bed. To dismount the side wall system, the clamp/release tool is inserted into the side wall interior via opening 6 made on the side wall top edge so deep that a pivot pin 8 of the magnet operating tool meets the upper edge of the side wall, however, at the same time ascertaining that the tip of the tool is passed below the free end of the link lever 3. Next, the clamp/release tool is rotated in the direction indicated by the arrow, whereby the slanted surface of the front side of the tool tip is forced against magnet operating lever pin 9 thus causing the pin to slide upward along the slanted surface of the tool tip, whereupon the free end of the link lever rises and the lever lifts the magnet off from the surface of the casting bed. The rotation of the clamp/release tool is continued until the magnet hits the surface 4 defining its upper position. In the end position of the clamp/release tool, the pin at the free end of the link lever remains resting in a notch made to the proximal recess end of the slanted surface of the clamp/release tool tip, whereby the entire side wall system can be elevated away from the casting bed using the clamp/release tool as a lift hook.

Figure 3:
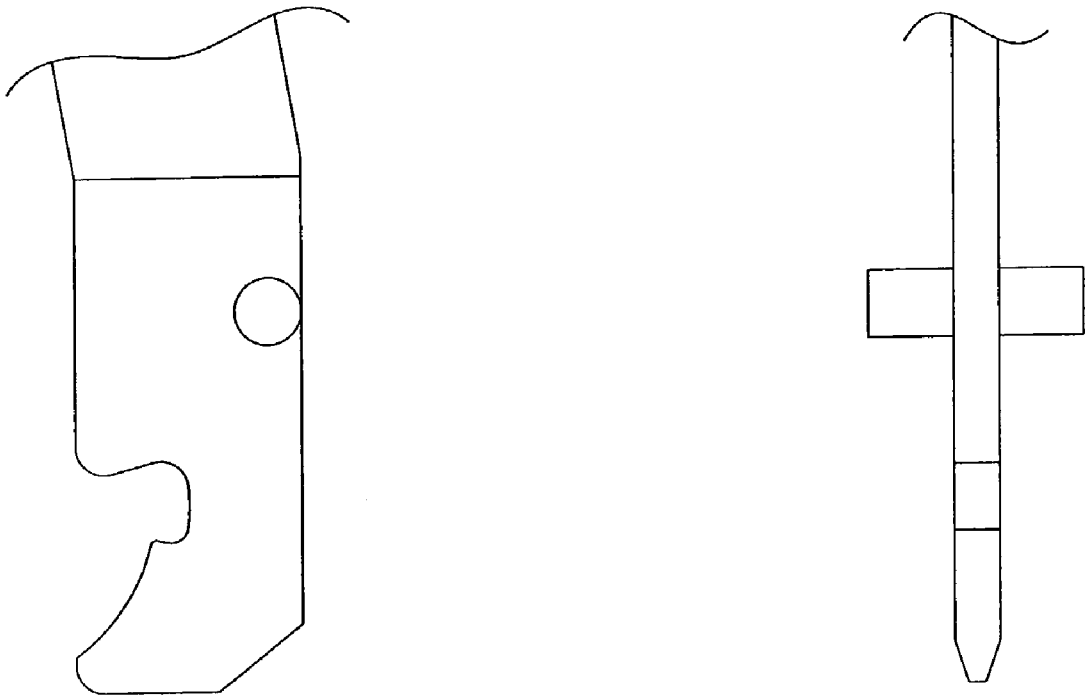
FIG. 3 shows a tool suitable for use in the clamping and release steps of the dismountable casting mold side wall system according to the invention.

In FIG. 3 is shown the contour of the clamp/release tool tip. The slanted portions of the tool tip illustrated in the frontal projection of the clamp/release tool help the tool find the narrow opening on the top edge of the side wall.

The clamp magnet release and clamping operations as well as the transfer of side wall system can be readily automated by way of operating the clamp/release with the help of a robotic system.

Obviously a single side wall system may include plural clamp magnets.

What is claimed is:

1. A side wall system for concrete casting molds, the system including a side wall attachable dismountably to the casting mold and a pivoted operating link lever having a magnet adapted to clamp onto a casting bed so as attach said side wall thereto, wherein pivotal release/clamp operations of the magnet are adapted to take place in an interior space remaining between exterior sides of said side wall, wherein a top edge of said side wall is provided with an opening for insertion of a tool used in the pivotal clamp/release operations of said magnet.

2. The side wall system of claim 1, wherein said dismountable side wall is designed into a box-section structure.

3. The side wall system of claim 1, wherein all components of said magnet are adapted to fit into the interior space remaining between the exterior sides of said side wall.

4. The side wall system of claim 1, wherein said tool used for pivotal release/clamp of said magnet is adapted to rest against the top edge of said side wall during the pivotal release/clamp operations of said magnet.

5. The side wall system of claim 2, wherein all components of said magnet are adapted to fit into the interior space remaining between the exterior sides of said side wall.

6. The side wall system of claim 2, wherein a top edge of said side wall is provided with an opening for insertion of a tool used in the pivotal clamp/release operations of said magnet.

7. The side wall system of claim 3, wherein a top edge of said side wall is provided with an opening for insertion of a tool used in the pivotal clamp/release operations of said magnet.

8. The side wall system of claim 5, wherein a top edge of said side wall is provided with an opening for insertion of a tool used in the pivotal clamp/release operations of said magnet.

9. The side wall system of claim 6, wherein said tool used for pivotal release/clamp of said magnet is adapted to rest against the top edge of said side wall during the pivotal release/clamp operations of said magnet.

10. The side wall system of claim 7, wherein said tool used for pivotal release/clamp of said magnet is adapted to rest against the top edge of said side wall during the pivotal release/clamp operations of said magnet.

11. The side wall system of claim 8, wherein said tool used for pivotal release/clamp of said magnet is adapted to rest against the top edge of said side wall during the pivotal release/clamp operations of said magnet.

* * * * *